US006817492B1

(12) United States Patent
Smith

(10) Patent No.: US 6,817,492 B1
(45) Date of Patent: Nov. 16, 2004

(54) CARTRIDGE DISPENSER EXTENSION AND EXTRUSION SYSTEM

(76) Inventor: Timothy W. Smith, 11445 Conte Playa Laguna, San Diego, CA (US) 92124

( * ) Notice: Subject to any disclaimer, the term of this patent is extended or adjusted under 35 U.S.C. 154(b) by 0 days.

(21) Appl. No.: 10/393,650

(22) Filed: Mar. 19, 2003

(51) Int. Cl.[7] ..... B67D 5/00

(52) U.S. Cl. ..... 222/390; 222/323; 222/326; 222/333; 222/309; 222/391

(58) Field of Search ..... 222/174, 309, 222/323, 333, 326, 327, 390, 391

(56) References Cited

U.S. PATENT DOCUMENTS 4,560,352 A * 12/1985 Neumeister et al. ..... 433/90
4,653,675 A * 3/1987 Ratzky ..... 222/390
6,454,136 B1 * 9/2002 Evans ..... 222/174

* cited by examiner

*Primary Examiner*—J. Casimer Jacyna
(74) *Attorney, Agent, or Firm*—Donn K. Harms

(57) ABSTRACT

A dispensing device adapted for operative attachment to flanged cartridges containing viscous material. The device features an elongated support tube having a laterally translatable rod assembly therein which translates through rotation of the rod assembly to disperse material from an attached cartridge. The elongated device allows for the vicious material to be deposited in hard to reach areas between and behind appliances. Activation by rotation of the rod assembly allows for extremely accurate placement of material from the cartridge. Rotational activation also allows the device to reach under very low sitting appliances. The support tube and rod assembly may be assembled in various lengths from individual components allowing the device to be changed from an elongated form to shorter components for shipping or storage. An optional light is provided to illuminate target for deposit of viscous material.

16 Claims, 2 Drawing Sheets

26A
28
20
16
14
18

12
106
106
22C
32
104
26A 10
26A
24A
56
52
54
30
16
14
28

12
46
48
32
44
22A
40
38
42
50
34
94
98
100
98
102

CARTRIDGE DISPENSER EXTENSION AND EXTRUSION SYSTEM

FIELD OF THE INVENTION

The disclosed device relates to cartridge discharged material. More particularly the disclosed device relates the dispensing of prepackaged material from cartridges through a controlled volume orifice. The disclosed device provides for the controlled placement of material from the cartridge by means of rotating a hand knob attached to a threaded rod assembly designed to thereby translate a plunger within a piston-like sleeve in the flanged dispenser, forcing the material out the controlled volume orifice.

A conventional device used for this application is the caulking gun with its pistol type squeeze grip used to dispense caulk or similar materials. With this type of application a cylindrical tube is inserted into the dispensing apparatus that restricts the cylinder from the front adjacent to the dispensing nozzle. Pressure is exerted on an internal piston-like sleeve by squeezing a pistol grip actuating a rod and plunger by a ratcheting means to dispense a prepackaged substance.

Another and equally effective method of similarly extruding a prepackaged substance in a flanged dispenser through a controlled volume orifice is accomplished by squeezing a pistol grip mechanism, actuating a rod and plunger with a ratcheting mechanism, pressing an internal piston like sleeve and forcing the material out the controlled volume orifice. The method of restraining this type of cylindrical container for dispensing the material is by the means of a top and bottom flange at the rear of the container.

BACKGROUND OF THE INVENTION

Licensed pest control operators have found in dispensing insecticide in commercial establishments and private residences that it is extremely difficult to deposit the desired amount of insecticide in exactly the proper locations. This is especially true when the access to those locations is tight or is obstructed by furniture, appliances, or other difficult to move objects. Commercial gel type insecticides are most commonly dispensed by the means of a cylindrical container with opposing flanges at rear to be attached to a conventional dispensing gun. This form of container is often used in the field of pest control to dispense insecticides in cracks and crevices, the need for which is often in hard to reach areas behind appliances in commercial establishments as well as residences. There are precise amounts and locations that the appropriate insecticide can legally be deposited depending on the material applied and the location.

Commercially available dispensing devices for substances in this style of container feature a pistol grip mechanism that restrains the cylindrical tube type container of insecticide gel by an upper and lower flange attachment. Such devices function much the same as a caulking gun where a trigger is activated by the user's fingers which in turn imparts pressure to the rear of the container to force gel from the front of the container. Such commercially available dispensers, however, are of limited use when trying to reach difficult areas other than moving the appliances out of the way. Too often these appliances are connected to electrical, water or sewer lines that make the job extremely difficult. Other problems arise when the area cannot be seen adequately to know if the gel or other material is being placed properly. Still another problem arises when the handle of a conventional applicator gun is squeezed and the material continues to run out the dispensing orifice after the squeezing has stopped due to the ratcheting mechanism. This can inadvertently place the dispensed material where it should not safely or legally be located. Additionally, when trying to place material from such dispensing guns on high ledges or walls and the like, a ladder is required.

The device herein disclosed provides a means to reach areas that have been either impossible or hard to reach, with ease, through the provision of a flanged dispenser extension and extrusion system which allows the user to dispense a precisely controlled amount of insecticide or other substances in these areas by rotating a hand knob. The substance application ceases immediately when rotating of the hand knob stops. Additionally, the device can be provided in variable lengths which can be assembled by simply adding or subtracting central lengths within the system. Further utility is provided by a small flashlight or other illumination means which may be attached to the device for viewing into dark and hard to reach areas for proper placement of the material. Finally, high areas may be reached using the device without a ladder, and when combined with the angled tip adapter, both high places and confined places are easily accessed by the user.

U.S. Pat. No. 3,512,684 of (Sutton) describes an extended in length gun for the use with conventional cartridges of caulking compound and the like. The gun includes a handle and trigger assembly and a cartridge holding chamber, joined by an elongated cylindrical casing within which a guide tube is mounted for receiving the pressure rod of the gun. The guide tube prevents bowing or deflection of the pressure rod, thereby assuring even dispensing of the material when the trigger is actuated. Sutton describes the conventional style of ratchet caulking guns restraining the cartridge at the front adjacent to the controlled volume orifice. It does not describe the rotational activation means, the variable extension means, the restraining of the cartridge by the opposing flanges at the rear or the addition of the flashlight.

U.S. Pat. No. 3,726,440 (Deeb) teaches of a caulking gun where the cartridge chamber is connected with the trigger assembly by a tubular casing and a pressure member which are adjustable so as to provide a caulking gun of any desired length and the trigger assembly is rotatably connected to the tubular casing or to the cartridge chamber so that the relative position of these two components may be varied. Deeb describes an extension to a conventional ratchet-style caulking gun restraining the cartridge at the front adjacent to the controlled volume orifice. It does not describe the rotational activation means, the variable extension means, the restraining of the cartridge by the opposing flanges at the rear or the addition of the flashlight. With the ratchet-style of caulking gun the only way to stop the material flow is to turn the angled end of the central shaft containing the ratchet teeth. If not turned, the spring pressure of the mechanism will continue to extrude the material until the pressure is released by reaching the next restraining tooth.

U.S. Pat. No. 4,932,565 (Paradiso) additionally discloses a caulking gun or the like for the dispensing of construction materials such as caulk, glue, sealant, etc. It is provided with a guide at its front end to enable the user more easily and readily to follow an object such as a construction member, groove and other line to which the material is applied. It is provided with an elongated extension, enabling operation of the gun by a standing rather than a kneeling workman. Paradiso tells of another extendable conventional ratchet-style caulking gun restraining the cartridge at the front adjacent to the controlled volume orifice, and does not describe the rotational activation means, the variable extension means, the restraining of the cartridge by the opposing flanges at the rear or the addition of the flashlight.

U.S. Pat. No. 5,692,642 (Brattesani) describes a fluid dispenser adapter and method of use. It is a dispenser adapter which allows dispensing of multiple types of materials with use of a single dispensing device. The invention includes a cartridge holder with a socket for receiving a replaceable cartridge of adhesive, filler, or other material. The cartridge holder is reversibly coupled to a dispensing device such as a syringe or dispensing gun. A plunger associated with the cartridge holder forces material from the cartridge. Force is transferred from the piston of the dispensing device to the plunger of the dispenser adapter apparatus by mechanical interfacing the piston and plunger. Brattesani thus teaches a device more in line with the medical field, not requiring any extendable capabilities and would not lend itself to the use of insecticides.

U.S. Pat. No. 5,743,431 (Brattesani) discloses a dispenser adapter apparatus which allows activation and dispensing of multiple types of materials with use of a single dispensing device. The cartridge holder is reversibly coupled to a dispensing device such as a syringe or dispensing gun. The '431 patent of Brattesani tells of another device more in line with the medical field, not requiring any extendable capabilities and would not lend itself to the use of insecticides.

U.S. Pat. No. 6,089,412 (Snell, et al.) teaches of a multipurpose dispenser system including a hand-held dispenser which is capable of dispensing viscous fluid and particulate materials. When dispensing viscous fluids, the dispenser precisely dispenses such materials without wasteful post-extrusion. The system also includes an adapter for mounting a particulate material dispenser to the dispenser as well as particulate material dispenser cartridges suitable for mounting to the dispenser. The '412 patent of Snell tells of a unique dispenser that endeavors to solve the wasteful post-extrusion problem, but still uses a similar ratcheting mechanism, not the rotational activation means, the variable extension means, or the addition of the flashlight described within this disclosure, although it is adaptable to restraining of the cartridge by the opposing flanges at the rear.

Consequently, there exists a need for a flanged cartridge dispenser extension and extrusion system that will allow material to be dispensed in tight or hard to reach locations which previously would not have been accessible without moving appliances. Such a device should be easy to use and allow for easy mounting and dismounting of cartridges holding the material being dispensed. Such a device should also provide for maximum accuracy in the amount of material dispensed as well as helping to prevent dripping of the potentially hazardous material while the device is dispensing or being removed from a dispensing position.

SUMMARY OF THE INVENTION

A preferred embodiment of the flanged cartridge dispenser extension and extrusion system provides the user the ability to deposit controlled amounts of a substance in specific target areas. The gel or other substance so dispensed by the device can easily be deposited into areas behind hard to move appliances. Viewing of the dispersed material and its location is enhanced with the aide of an attached light source if there is not sufficient light available to see adequately.

Dispensing of material is accomplished with an extendable cylindrical shaft featuring a hand knob at the distal end and a flange dispenser mount at the other. The hand knob is attached to the threaded end of a central rod assembly which translates in the central shaft by the means of the thread engagement in the internally threaded end of the support tube assembly. The hand knob may also provide a hexagonal or other adapter on the distal providing an engagement by which a cordless electric drill or screwdriver may be attached for rapid power assisted extraction of the plunger from the flanged dispenser cartridge. An optional handle may also be incorporated to the hand knob for rapid manual extraction of the plunger. Both the support tube assembly and the central rod assembly may be one-piece units or they may be comprised of two or more segments joined by coupling units.

The coupling units on the support tube assembly consist of a male threaded coupler and a female threaded coupler attached to opposing parts of the support tube assembly. The central rod assembly will be joined by the means of a threaded stud in the end of the first section of the central rod and a female thread in the end of the second section of the central rod, with a lock nut or other means of locked engagement to assure that the union does not come apart when the hand knob is turned to extrude the substance from the flanged dispenser cartridge. The central rod is provided with one or a plurality of O-rings located in O-ring grooves to centralize the rod within the internal chamber of the support tube and keep the rod from sliding out of the device.

A flanged dispenser mount is attached to the opposite end of the support tube from the hand knob and is adapted for cooperative engagement with one end of a dispenser cartridge. In the current best mode this cooperative engagement is provided by a top groove and a bottom groove in the dispenser mount whereby a flanged dispenser cartridge may be removably attached. A plunger on the distal end of the central rod assembly comes through an orifice centrally located in the flanged dispenser mount to press the internal piston like plunger in the flanged dispenser cartridge used in combination herewith to thereby extrude the substance through the controlled volume orifice.

An alternate preferred embodiment of the flanged cartridge dispenser extension and extrusion system will have an optional flange end on the support tube assembly to be assembled to a conventional ratchet style flanged cartridge dispensing gun for dispensing substances in similar fashion. This embodiment will not have the threaded end on the central rod, but will be provided with a section that will fit within the optional flange end to be pressed by the plunger on the conventional ratcheting style flange cartridge dispensing gun. The center portion of the central rod assembly may be constructed of a solid piece or could be a tubular member.

Means for illumination of the target area is provided by a light or flashlight which can be mounted on the support tube assembly adjacent to the flanged dispenser mount. Such a means for illumination provides viewing light during the application process when there is not enough light available. When tubing is used for the central rod assembly, the plunger end may have an enlarged end to replace the O-ring for stopping the central rod from sliding out of the device.

Another preferred embodiment of the device features small barbs on the distal end of the plunger that will lock the plunger within the internal piston like sleeve of the flanged dispense cartridge. This allows the plunger to be retracted when the hand knob is turned in the opposite direction. These barbs will disengage with the piston-like sleeve when the plunger is retracted into the counter bore area in the orifice in the flanged dispenser mount. This provides the user with absolute control of the amount dispensed and also allows the remainder of dispensed material, if left on the tip of the controlled volume orifice, to be pulled back into the flanged dispenser cartridge.

As such, those skilled in the art will appreciate that the conception upon which this disclosure is based may readily be utilized as a basis for designing of other structures, methods and systems for carrying out the several purposes of the present invention. It is important, therefore, that the claims be regarded as including such equivalent construction insofar as they do not depart from the spirit and scope of the present invention.

An object of the flanged cartridge dispenser extension and extrusion system herein disclosed is to create a means to dispense a controlled amount of a substance from a cartridge in hard to reach areas.

Another object of this flanged cartridge dispenser extension and extrusion system is to create an applicator that will immediately cease material dispensing when rotating the handle activating the device ceases.

An additional object of this flanged cartridge dispenser extension and extrusion system is to create a means to vary the length of the substance dispensing system.

A further object of this flanged cartridge dispenser extension and extrusion system is to create a means to replace the inaccurate and hard to use pistol grip system with an accurate and easy to use rotationally activated system.

Yet another object of this flanged cartridge dispenser extension and extrusion system is to have lengths short enough to be easily packaged, shipped and stored.

An additional object or the device herein disclose is the provision of an alternate embodiment adapted to attach to, and extend, a conventional flanged cartridge dispenser gun.

Still another object of the flanged cartridge dispenser extension and extrusion system is to have an alternate embodiment that will have small barbs on the plunger that will lock into the internal piston-like sleeve in the dispenser cartridge to allow the piston-like sleeve to be pushed forward, stopped or retracted within the cylinder and will pull out when the plunger is fully retracted into the flanged dispenser mount.

A further object of this flanged cartridge dispenser extension and extrusion system is the provision of a dispensing device for cartridge housed material which also provides light to the target area for the material to be deposited.

A final object of this flanged cartridge dispenser extension and extrusion system is to supply a new and more universal tool to be used for dispensing prepackaged substances from a flanged dispenser cartridge.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE DRAWINGS

The accompanying drawings, which are incorporated in and form a part of this specification, illustrate preferred embodiments of the invention and together with the description, serve to explain the principles of the device herein disclosed.

DETAILED DESCRIPTION OF THE PREFERRED EMBODIMENTS

Figures 1, 5, 6, 7:
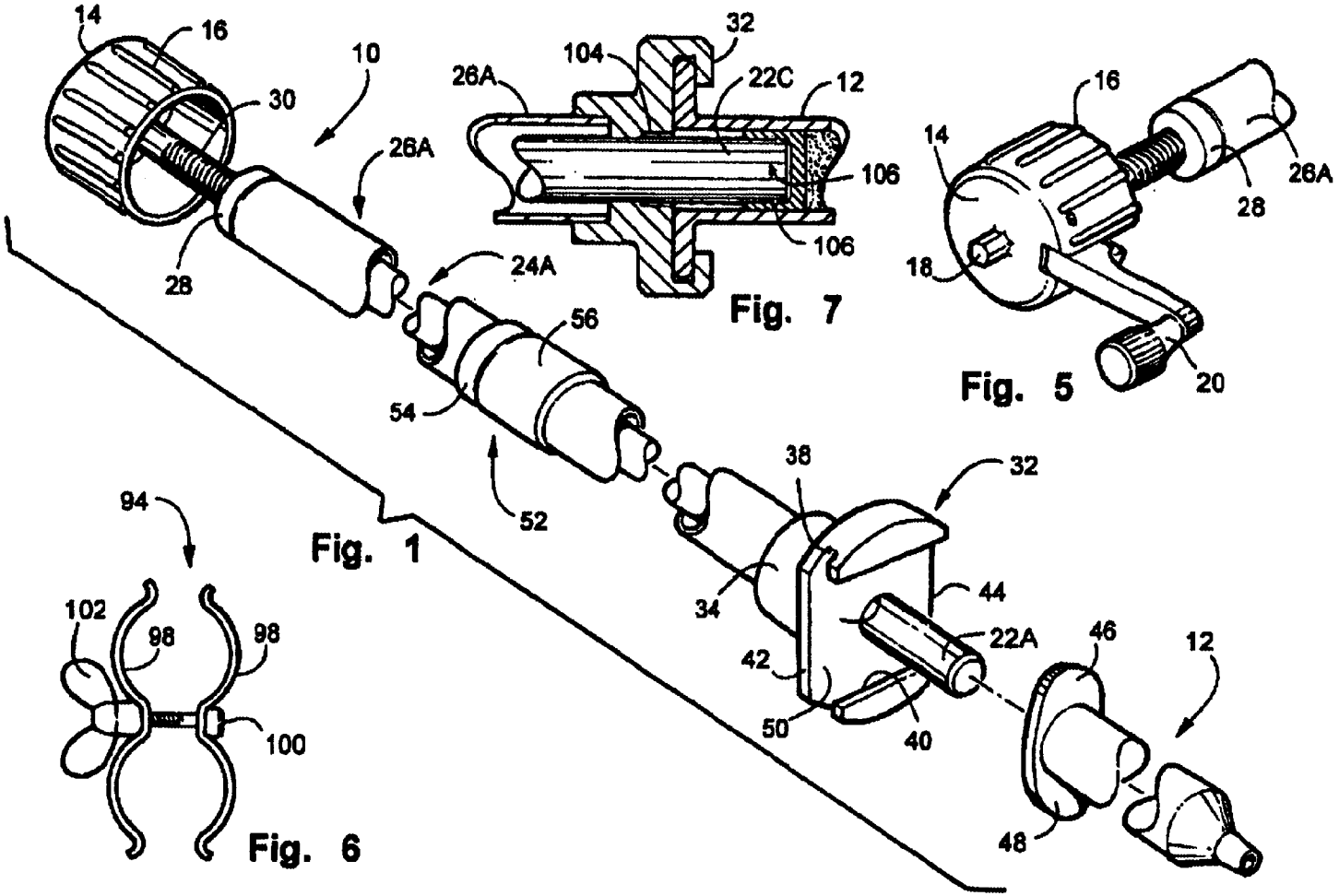
FIG. 1 depicts an exploded perspective view of the flanged cartridge dispenser extension and extrusion system and the flanged dispenser cartridge used in combination herewith.
FIG. 5 is a perspective view of the rotatable hand knob with the hexagonal adapter and the optional high-speed return hand knob.
FIG. 6 is an end view of the flashlight clamp assembly.
FIG. 7 is a side view of the optional barbed end of the plunger and a portion of the flanged dispenser mount.

Referring now drawings 1–7, wherein similar parts of the invention are identified by like reference numerals, there is seen in FIG. 1 an exploded perspective view of the flanged cartridge dispenser extension and extrusion system 10 and a flanged dispenser cartridge 12 which is used in combination herewith. A rotatable hand knob 14 further illustrated in FIG. 5 shows the non-slip grip 16, the hexagonal adapter 18 and the optional high-speed return handle 20. The hexagonal adapter 18 is a convenient means of engagement of the hand knob 14 with the chuck of a power drill or screwdriver which can be used for rotating the hand knob 14 rapidly thereby quickly retracting the plunger end 22A located on the distal end of the central rod assembly 24A or 24B. The central rod assembly 24A translates through a support tube assembly 26A by the means of a rotational engagement herein depicted as an internally threaded end 28 and the threaded portion 30 of the central rod assembly 24A adjacent to the hand knob 14 thereby providing a means to translate the central rod assembly activated by rotating it. Translating the central rod assembly 24A causes the attached dispenser cartridge 12 to disperse material.

The flanged dispenser mount 32 is located at the opposite end of the support tube assembly 26A from the internally threaded end 28 attached by the means of a sleeve end 34. This attachment of the support tube assembly tube 26A and 26B to the flanged dispenser mount 32 may be accomplished by an adhesive means or threaded attachment or might be formed as part of the end of the support tube assembly 26A in a molding process and still remain within the scope of this patent. The flanged dispenser mount 32 is adapted for cooperative removable engagement with the mounting end of a dispenser cartridge 12. The current preferred means of cooperative removable engagement of the flanged dispenser mount 32 and a dispenser cartridge 12 features the flange mount portion 36 of the flanged dispenser mount 32 has a top mount groove 38 and a bottom mount groove 40. The flanged dispenser mount 32 is relieved on the right side 42 and left side 44 to allow the top flange 46 and bottom flange 48 of a conventional flanged dispenser cartridge 12 to be rotated into a locked position against the flange mount face 50. Removal of the flanged dispenser cartridge would be accomplished in reverse fashion.

Orifice 53 allows the plunger end 22 of the central rod assembly 24A or 24B to translate through the attached flanged dispenser mount 32 into an engaged flanged dispenser cartridge 12. One or more coupling units 52 may be added to the support tube assembly 26A or 26B to extend the total length of the flanged cartridge dispenser extension and extrusion system 10. Each coupling unit 52 will consist of a male threaded end 54 and a female threaded end 56 to be attached to the support tube assembly by the means of adhesive, molding, threaded engagement or other means of attachment.

Also depicted in FIG. 1 is an optional angled tip 55 which is adapted for sealed engagement with the conventional disbursement tip 57 of the dispenser cartridge 12 used in combination herewith. The angled tip 55 can be provided in a kit of such angled tips 55 each with a different angle of the dispensing tip 59 off of an inline engagement. This provides the user the ability to add the angled tip 55 of choice to the dispenser cartridge 12 used and get into even more cramped spaces easier. Currently tips at angles between thirty degrees to sixty degrees would provide the most aid in use to the user.

Figures 2, 3, 4:
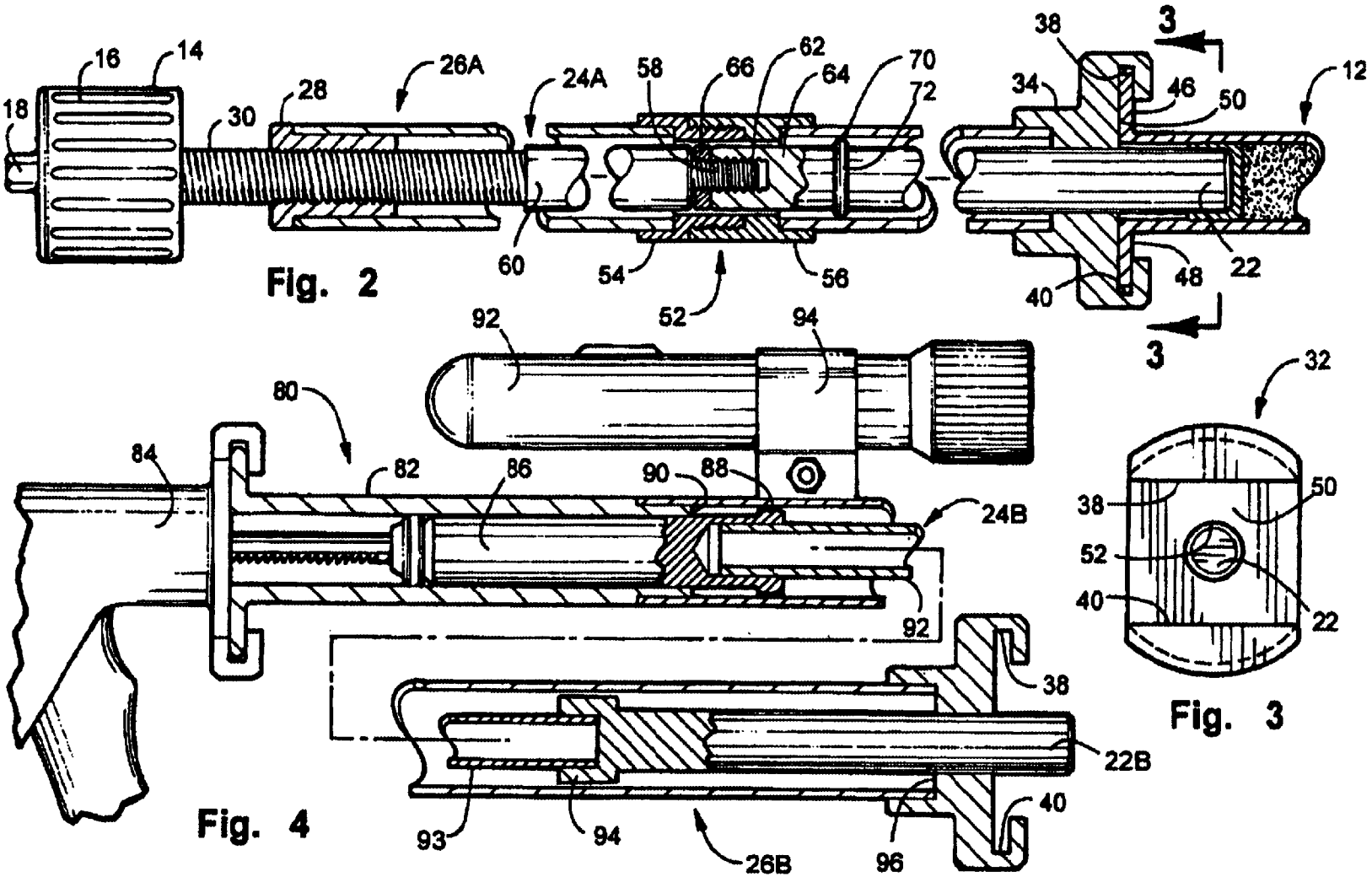
FIG. 2 depicts a partial section through the preferred embodiment of the flanged cartridge dispenser extension and extrusion system with the flanged dispenser cartridge used in combination herewith, in place.
FIG. 3 depicts an end view of the flanged dispenser mount on the flanged cartridge dispenser extension and extrusion system.
FIG. 4 depicts a partial section through an alternate embodiment of the flanged cartridge dispenser extension and extrusion system with the optional flanged end adapted for attachment to a conventional ratchet style dispenser gun.

FIG. 2 further clarifies the internal portion of the device by depicting a partial section through the flanged cartridge dispenser extension and extrusion system 10 with the rotatable hand knob 14 having a non-slip grip 16 and hexagonal adapter 18 attached at the distal end of the central rod assembly 24A. The threaded portion 30 of the central rod assembly 24A maintains a thread engagement with the internally threaded end 28 of the support tube assembly 26A allowing that the central rod assembly 24A can be minutely adjusted for lateral translation with relation to the support tube assembly 26A. The assembly of a single piece support tube assembly is accomplished from a plurality of shorter tube assembly components through the provision of a means for coupling the components together into a single, in-line tube. In the current best mode, one or more coupling units 52, comprised of a male threaded end 54 and a female threaded end 56 are attached to the support tube assembly depending on the total length desired. Of course those skilled in the art will realize that the support tube assembly 26A or 26B could be made in on piece without the coupling unit 52 and such is anticipated within the scope of this invention. However, since transport of the device is easier when broken down into shorter pieces, and since the inclusion of one or more coupling units 52 and one or a plurality of support tube assemblies 26A or 26B provide for easy adaptation of the total length of the device, inclusion of the coupling unit 52 is preferred.

The central rod assembly 24A and 24B may be comprised of one or more elongated rod segments attached together using a means for attachment of the segments to form a substantially straight rod assembly of the desired length. This engagement of the rod segments in the current preferred mode of the device is accomplished by the means of a male threaded end 58 of the first segment 60, engaging within the female threaded end 62 of the second segment 64 restrained by means for locking their engagement depicted herein as lock nut 66. One or a plurality of o-rings 68 may be located in o-ring grooves 70 along the length of the central rod assembly 24A or 24B or the interior passage of the support tube assembly as centralizers to restrain the central rod assembly 24A or 24B within the support tube assembly and to keep all or part of the central rod assembly 24A and 24B from inadvertently sliding out of the device. The plunger end 22A is shown within the flanged dispenser cartridge 12 engaged in the internal piston like sleeve 72.

FIG. 3 depicts an end view of the flanged dispenser mount 32 operatively affixed on the support tube assembly clarifying the shape of the flange mount portion 36 and the sides 42 and 44. As noted this configuration is adapted for cooperative engagement with the flange end of conventional dispenser cartridges 12.

FIG. 4 depicts a partial section through an alternate embodiment 80 of the flanged cartridge dispenser extension and extrusion system featuring a flanged end 82 attached to the support tube assembly 26B thereupon to a conventional ratchet style trigger activated dispenser gun 84. While not as functional as the first preferred embodiment 10, this embodiment would allow users owning conventional trigger activated dispenser guns 84, to still reach into cramped and hard to reach target areas. This embodiment would also feature a support tube assembly 26B comprised of one or a plurality of segments joined by a coupling unit 52 in the best mode since it would allow of the adjustment of length. Also depicted is the alternate style of rod assembly 24B featuring end unit 86 which is required when using the optional end flange 82 with the enlarged end 88 providing a means for retaining the central rod assembly 24B within the support tube assembly 26B using the stop end 90 of the optional flanged end 82 which would impede enlarged end 88 from passing and allowing the central rod assembly 24B to fall out of the end flange 82. This allows for the device to be carried and attached to a conventional trigger activated dispenser gun 84 without coming apart.

A means for illumination of the area adjacent to the dispensing end is provided in the form of flashlight 92 and the flashlight clamp 94 shown in FIG. 4. However, it will be understood to those skilled in the art that this means for illumination may also be used on the flanged cartridge dispenser extension and extrusion system 10 or the alternate embodiment of the flanged cartridge dispenser extension and extrusion system 80 or any combination thereof and still remain within the scope of this patent.

The center section 93 of the central rod assembly 24B is shown as a tubular member rather than a solid member, shown in FIG. 2 with both functioning for the same purpose. An optional plunger end 22B with an enlarged end 94 will abut against the shoulder 96 on the flanged dispenser mount 32 retaining the central rod assembly 24B within the support tube assembly 26B.

FIG. 6 is an end view of the flashlight clamp assembly 94 consisting of two clamp plates 98, a screw 100, and a wing nut 102.

FIG. 7 is a side view of the optional barbed end of the plunger 22C fixably engaged within the piston like sleeve 72 of the flanged dispenser cartridge 12 and a portion of the flanged dispenser mount 32B with orifice 52 having a counter bore 104 to allow clearance for the barbs 106 when they are retracted from the piston like sleeve 72.

The flanged cartridge dispenser extension and extrusion system shown in the drawings and described in detail herein discloses arrangements of elements of particular construction and configuration for illustrating preferred embodiments of structure and method of operation of the present invention. It is to be understood, however, that elements of different construction and configuration and other arrangements thereof, other than those illustrated and described may be employed for providing a flanged cartridge dispenser extension and extrusion system in accordance with the spirit of this invention. All such changes, alternations and modifications as would occur to those skilled in the art are considered to be within the scope of this invention as broadly defined in the appended claims.

What is claimed is:

1. A material dispenser for use in combination with a cartridge containing viscous material comprising:

an elongated support tube having an interior passage defined by a sidewall;

said support tube having an activation end and an attachment end;

a rod assembly extending through said interior passage, said rod assembly having and exterior surface, a distal end extending from said activation end of said support tube, and having a plunger end opposite said distal end;

a flange engaged at said attachment end of said support tube, said plunger end of said rod assembly extending from said activation end of said support tube into said flange;

said flange adapted for attachment with a first end of a cartridge containing viscous material;

said rod assembly in rotational engagement with said support tube wherein rotation of said rod assembly laterally translates said rod assembly in said interior passage of said support tube; and wherein rotating said rod assembly laterally translates said plunger end into said first end of said cartridge thereby urging discharge of material from said cartridge.

2. The material dispenser of claim 1 wherein said rotational engagement of said rod assembly with said support tube comprises:

threads on an exterior surface of said rod engaged with threads located on said support tube.

3. The material dispenser of claim 1 additionally comprising:

said rod assembly comprised of a plurality of rod segments;

means to removably engage said plurality of rod segments to each other to form said rod assembly;

said support tube comprised of a plurality of support tube segments;

means to removably engage said plurality of support tube segments to each other to form said support tube; and were by said material dispenser may be assembled from said plurality of rod segments and said plurality of support tube segments to an elongated state and disassembled thereafter.

4. The material dispenser of claim 1 additionally comprising:

said rod assembly comprised of a plurality of rod segments;

means to removably engage said plurality of rod segments to each other to form said rod assembly;

said support tube comprised of a plurality of support tube segments;

means to removably engage said plurality of support tube segments to each other to form said support tube; and were by said material dispenser may be assembled from said plurality of rod segments and said plurality of support tube segments to an elongated state and disassembled thereafter.

5. The material dispenser of claim 2 additionally comprising:

said rod assembly comprised of a plurality of rod segments;

means to removably engage said plurality of rod segments to each other to form said rod assembly;

said support tube comprised of a plurality of support tube segments;

means to removably engage said plurality of support tube segments to each other to form said support tube; and were by said material dispenser may be assembled from said plurality of rod segments and said plurality of support tube segments to an elongated state and disassembled thereafter.

6. The material dispenser of claim 1 additionally comprising:

said distal end of said rod assembly adapted for cooperative engagement with the engagement end of a rotating power tool whereby said rod assembly may be rotated by activation of said power tool.

7. The material dispenser of claim 2 additionally comprising:

said distal end of said rod assembly adapted for cooperative engagement with the engagement end of a rotating power tool whereby said rod assembly may be rotated by activation of said power tool.

8. The material dispenser of claim 3 additionally comprising:

said distal end of said rod assembly adapted for cooperative engagement with the engagement end of a rotating power tool whereby said rod assembly may be rotated by activation of said power tool.

9. The material dispenser of claim 1 additionally comprising:

a means for illumination of areas adjacent to said attachment end of said support tube; and means of attachment of said means for illumination to said support tube.

10. The material dispenser of claim 1 additionally comprising:

means to engage an exterior surface of said rod assembly with said interior passage of said support tube wherein, said rod assembly will rotate in said interior passage while concurrently preventing said rod assembly from sliding out of said interior passage.

11. A material dispenser for use in combination with a cartridge containing viscous material comprising:

an elongated support tube having an interior passage defined by a sidewall;

said support tube having an activation end and an attachment end;

a rod assembly extending through said interior passage, said rod assembly having a distal end extending from said activation end of said support tube, and having a plunger end opposite said distal end;

a flange engaged at said attachment end of said support tube, said plunger end of said rod assembly extending from said activation end of said support tube into said flange;

said flange adapted for attachment with a first end of a cartridge containing viscous material, a second flange located at said activation end;

said second flange adapted for cooperative engagement with a dispenser unit adapted to engage said first end of said cartridge, said dispenser unit having a translating member protruding a distance therefrom;

said translating member contacting said distal end of said rod assembly when said second flange is in cooperative engagement with said dispenser unit;

said translating member providing a means to laterally translate said rod assembly when said dispenser unit is activated to cause said translating member to increase said distance; and wherein activating said dispenser unit to laterally translate said translating member laterally translates said plunger end into said first end of said cartridge thereby urging discharge of material from said cartridge.

12. The material dispenser of claim 11 additionally comprising:

said rod assembly comprised of a plurality of rod segments;

means to removably engage said plurality of rod segments to each other to form said rod assembly;

said support tube comprised of a plurality of support tube segments;

means to removably engage said plurality of support tube segments to each other to form said support tube; and were by said material dispenser may be assembled from said plurality of rod segments and said plurality of support tube segments to an elongated state and disassembled thereafter.

13. The material dispenser of claim 11 additionally comprising:

means to engage an exterior surface of said rod assembly with said interior passage of said support tube wherein, said rod assembly will rotate in said interior passage while concurrently preventing said rod assembly from sliding out of said interior passage.

14. The material dispenser of claim 12 additionally comprising:

means to engage an exterior surface of said rod assembly with said interior passage of said support tube wherein, said rod assembly will rotate in said interior passage while concurrently preventing said rod assembly from sliding out of said interior passage.

15. The material dispenser of claim 1 additionally comprising:

a dispensing tip, said dispensing tip adapted for removable sealed engagement with the dispensing end of said cartridge opposite said first end;

said dispensing tip having an angled tip for disbursement of material from said cartridge therethrough.

16. The material dispenser of claim 15 wherein said dispensing tip is provided in a kit of said dispensing tips having angled tips.

* * * * *